United States Patent [19]

Peplowski

[11] Patent Number: 4,763,556

[45] Date of Patent: Aug. 16, 1988

[54] FLUTE INSTRUMENT DIGIT REST AND SPACER

[76] Inventor: Boleslaw J. Peplowski, Hacienda Underwood #5, Espanola, N. Mex. 87532

[21] Appl. No.: 8,543

[22] Filed: Jan. 29, 1987

[51] Int. Cl.[4] ..... G10D 9/00

[52] U.S. Cl. ..... 84/384; 84/453

[58] Field of Search ..... 84/382, 384, 453

[56] References Cited

U.S. PATENT DOCUMENTS

| | | | |
|---|---|---|---|
| 3,599,526 | 8/1971 | Sollecito et al. | 84/384 |
| 4,099,442 | 7/1978 | Amadio | 84/382 |
| 4,493,238 | 1/1985 | Ricci | 84/282 |

*Primary Examiner*—Lawrence R. Franklin

*Attorney, Agent, or Firm*—Daniel H. Kane, Jr.

[57] ABSTRACT

Flute attachments are provided for metal flutes to facilitate more favorable positioning of the flute player's hands. A resilient elastic clamp or clip in the configuration of an open circular arc greater than a half circle is constructed and arranged for clipping onto the round tubular body of a metal flute where the digit of a flute player normally rests against the flute body. The resilient clip includes a digit rest surface and a spacer element or portion spacing the digit rest surface from the body of the flute. The spacer is formed with a thickness to offset the digit of a flute player in the radial direction from the flute body a sufficient distance for minimizing cramping or fatigue of the digit and wrist of the flute player. In the preferrred embodiment, the resilient elastic clip is constructed and arranged for clipping onto the round tubular flute body between the upper C tone hole and the upper C finger key for resilient elastic retention to the flute body where the side of the left index finger normally rests against the flute body for multiple functions of the left index finger as a pivot point, pressure point, and operating finger of the upper C finger key. The spacer is formed with a spacing thickness in the range of approximately 0.3 to 0.8 cm. The finger rest surface may be a saddle shaped surface to provide secure finger positioning.

21 Claims, 3 Drawing Sheets

FLUTE INSTRUMENT DIGIT REST AND SPACER

TECHNICAL FIELD

This invention relates to new attachments for the round tubular body of metal flutes and to new flute designs to facilitate more natural placement and orientation of the flute player's hands. In particular, the invention provides a new left index finger rest and spacer for performing the multiple functions of the left index finger in a more favorable position, and to a right thumb position rest and spacer.

BACKGROUND ART

A recurring problem in learning to play the flute is the awkward positioning required of the hands and fingers for the proper placement of the musical instrument. Because of the small diameter of the tubular body of metal flutes, the left hand and left index finger must be turned inward in order for the side of the left index finger to bear against the flute and apply proper pressure on the instrument. It is this force applied by the side of the left index finger that in turn applies appropriate pressure of the flute mouthpiece against the flute player's lower lip. At the same time the left index finger must play the C' or upper C finger key while the left thumb is operating the B' or upper B and Bd' or upper B flat finger keys on the other side of the flute body. Additionally, the left index finger provides a pivot point for the flute in applying and transmitting further pressure from the right hand positioned on the lower end of the flute body to the upper end or head of the flute.

Because of the awkward position and unnatural posture required of the left hand and left index finger turned inwardly against the flute body, inexperienced players suffer fatigue and even cramping in the left fingers, wrist, and arm. Eventually, proper pressure is not applied. Fingering, particularly by the left hand, suffers as does the embouchure or embouchment referring to the proper deployment and use of the lips dependent upon proper pressure against the lower lip. The narrow diameter of the tubular body of metal flutes also presents problems for other digits including the right thumb. These difficulties present problematic hurdles for music teachers providing flute instruction and require attention even by experienced flute players.

OBJECT OF THE INVENTION

It is therefore an object of the present invention to provide new attachments for the tubular body of metal flutes and new flute designs which restore the left index finger and left hand and other affected digits to a more natural position in order to avoid or reduce fatigue and cramping.

Another object of the invention is to provide flute attachments and flute designs which permit the left index finger to apply pressure against the flute body and serve as a pivot point without the awkwardness and fatigue particularly experienced by novice flute players. The inventions also provides flute attachments and designs for other affected digits.

A further object of the invention is to provide inexpensive flute attachments applicable and suited for both learning students and experienced flute players for more efficient and effective placement of the hands and digits while accommodating flute requirements for fingering and embouchure.

DISCLOSURE OF THE INVENTION

In order to accomplish these results, the present invention provides a resilient elastic clamp or clip formed with an open circular arc greater than a half circle constructed and arranged for clipping onto the round tubular flute body where the digit of a flute player normally rests against the flute body. The resilient clip is formed with a digit rest surface and a spacer which displaces or spaces the digit rest surface from the flute body. In particular, the spacer is formed with sufficient thickness to offset or displace the digit of a flute player in the radial direction from the flute body a sufficient distance for minimizing cramping or fatigue of the digit and associated wrist and arm of the flute player and restoring the flute player's hand and arm to a more natural position.

In a preferred example embodiment, the resilient elastic clip or clamp is constructed and arranged for clipping onto the round tubular flute body between the upper C and C' tone hole and the upper C or C' finger key for resilient elastic retention. The resilient clip is positioned where the side of the left index finger of a flute player normally rests against the flute body for multiple functions of the left index finger as a pivot point, pressure point and operating finger for the upper C finger key. To this end the resilient clip is shaped with a skewed, irregular, or off center side lobe for elastic retention on the flute body without interfering with the adjacent tone holes or finger keys.

The spacer element or spacer portion of the clip is formed with a thickness to offset or displace the left index finger of a flute player in the radial direction from the flute body a sufficient amount to minimize or avoid cramping and fatigue of the left index finger and left wrist of a flute player. At the same time the left index finger is free to perform the multiple functions of pivot point, pressure point, and upper C operating finger.

For advantageous positioning of the left index finger in the radial direction, the spacer is formed with a thickness for offsetting or displacing the side of the left index finger at least approximately 0.3 cm and preferably at least approximately 0.6 cm in the radial direction away from the flute body or in the range of approximately 0.3 to 0.8 cm. For use by novice, beginner or learning flute students, the finger rest surface may be formed in the configuration of a saddle shaped surface for secure positioning of the left index finger at the optimum location as well as for spacing. According to this embodiment the minimum thickness of the spacer at the middle of the saddle shaped surface is at least approximately 0.3 cm, increasing to at least approximately 0.6 cm at the ends of the saddle. For experienced players the clip is formed with a finger rest surface of even cylindrical shape or curvature over the spacer. The spacer portion having a thickness, for example approximately 0.6 cm or in the preferred range of approximately 0.3 cm to 0.8 cm.

For the left index finger flute attachment, the finger rest surface and spacer means are offset around the circular arc of the clip or clamp from the center of the arc for optimum positioning where the side of the left index finger normally rests against the flute body. The clip may be formed as an integral piece for example molded of a relatively soft but elastic plastic with good memory such as PVC plastic which does not mar the metal surfaces of the flute. According to another embodiment, the spacer may be a separate piece of an oval shaped spacing element for example of button plastic in the preferred thickness range bonded to a circular arc clip of PVC plastic. The spacer element is then bonded at a location offset from the center of the arc.

According to another embodiment of the invention, the clip is constructed and arranged for clipping onto the undersurface of the round tubular flute body between the E and F tone holes of the flute. In this example, the digit rest surface and spacer are positioned on the undersurface of the tubular flute body where the right thumb of a flute player normally rests against the flute body. The spacer is formed with sufficient thickness to displace or offset the digit rest surface and thumb at least approximately 0.4 cm from the flute body along a radial direction or in the range of approximately 0.3 to 0.8 cm. For this location on the body of the flute the digit rest surface and spacer are formed at the center of the circular arc of the clip. The clip is formed with symmetrical curved arms on either side for elastic retention of the clip on the round tubular flute body.

The invention also contemplates new flute designs in which the finger rest surface and spacer element are formed as an integral part of the flute body rather than as attachments. For example, the left index finger rest and spacer or right thumb position rest and spacer may be molded as an integral part of the tubular body of the flute, or subsequently bonded to the flute body in a permanent position. Other objects, features, and advantages of the invention are apparent in the following specification and accompanying drawings.

BRIEF DESCRIPTION OF THE DRAWINGS

FIG. 6 is a side view of an alternative left index finger spacer clip with a saddle shaped finger rest surface particularly useful for teaching and learning flute playing while

DESCRIPTION OF PREFERRED EXAMPLE EMBODIMENTS AND BEST MODE OF THE INVENTION

Figure 1:
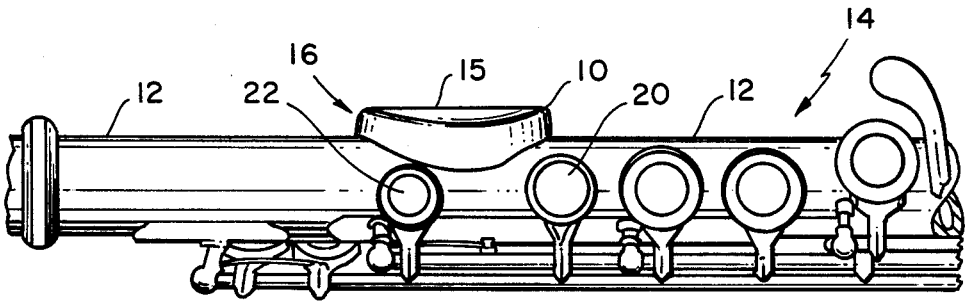
FIG. 1 is a fragmentary side view of a flute showing a left index finger spacer clip flute attachment according to the invention in place between the upper C tone hole and upper C finger key.
Figure 2:
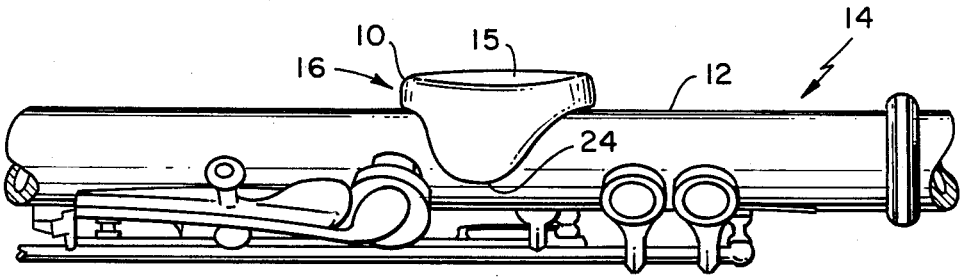
FIG. 2 is a fragmentary side view of the flute from the other side showing the same left index finger spacer clip in place.
Figure 3:
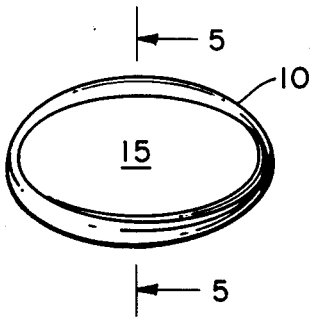
FIG. 3 is a plan view from above of the left index finger spacer clip removed from the flute.
Figure 4:
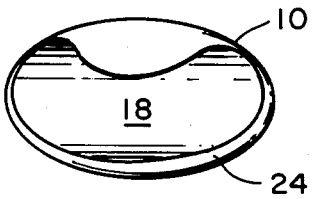
FIG. 4 is a plan view looking at the inside of the left index finger spacer clip from below, showing the undersurface of the spacer clip that engages the tubular flute body.

A left index finger rest and spacer clamp or clip 10 is shown in FIGS. 1 and 2 secured in position on the round tubular body 12 of standard metal flute 14. Plan views of the finger rest and spacer clip 10 from above and below separated from the flute are also shown in FIGS. 3 and 4. The spacer clip 10 is formed with a smooth finger rest surface 15 having a uniform cylindrical curvature configuration. The spacer, spacer element or spacer portion 16 displaces or offsets the finger rest surface 15 from the round tubular flute body 12 in this example approximately 0.6 cm (0.225 inches) for more favorable positioning of the left hand and left wrist.

Figure 5:
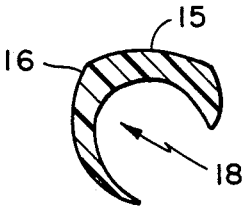
FIG. 5 is a cross section through the left index finger spacer clip in the direction of the arrows on lines 5—5 of FIG. 3 showing the thickness profile of the spacer portion or spacer element.

Referring to FIGS. 4 and 5, the spacer clip grasps the tubular body of the flute by means of an open circular arc 18 greater than a half circle formed on the undersurface of the clip. The thickness profile across the clip is shown in the cross section of FIG. 5. The actual location of the finger rest surface 15 is offset from the center of the arc 18 for optimum positioning of the left index finger relative to the flute body. The actual thickness of the spacer 16 at the center of the finger rest surface 15 offset from the center of the arc 18 may be for example 0.6 cm (0.225 inches) thereby displacing or offsetting the left index finger by that distance from the surface of the tubular body 12. The left hand and wrist may therefore be more favorably oriented in a natural position to minimize fatigue and cramping.

Because the radius of curvature of the cylindrical curvature configuration finger rest surface 15 is different from the radius of curvature of the arc 18, the thickness profile tapers to a greater thickness on either side of the middle of the finger rest surface 15 to a thickness for example of 0.7 to 0.75 cm (0.27 to 0.29 inches). At thicknesses below approximately 0.3 cm the advantages of favorable orientation of the left hand and wrist by reason of radial displacement from the flute body are lost while at thicknesses greater than 0.8 cm further difficulties in handling the flute are introduced. The preferred range of thickness of the spacer or spacer portion for radial displacement of the finger or digit is therefore in the range of 0.3 to 0.8 cm.

Referring t FIG. 2 it is noted that the finger rest surface 15 of the clip extends over a distance from at least the upper C or C' finger key 20 and the upper C tone hole 22. As also clearly shown in FIG. 2 the spacer clip 10 is formed with a skewed or off center lobe 24 on one side for elastic retention to the tubular body 12 without interfering with adjacent finger keys and tone holes.

Figure 1A:
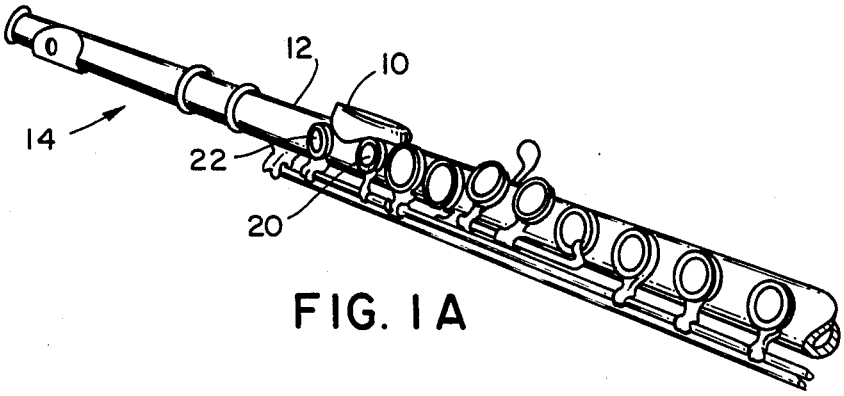
FIG. 1A is a more distant environmental perspective view of the flute in the direction of the flute head showing the position of the spacer clip flute attachment in relation to the flute head and alternatively viewed with the finger rest surface and spacer as an integral molded part or permanently bonded element of the tubular flute body.

The left index finger rest and spacer 10 is shown in further perspective in relation to the flute head in the environmental view of FIG 1A. It is apparent from this view that the digit rest and spacer 10 may be viewed and formed as an integral part of the tubular body 12 of flute 14. For example the finger rest and spacer portion 10 may be molded as a integral part of the flute body 12 or subsequently permanently bonded to the flute body 12. Thus the digit rest and spacer according to the present invention may be a permanent feature of the flute design rather than a removable and replacement clip.

Figure 6:
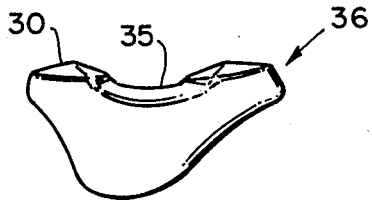
Figure 7:
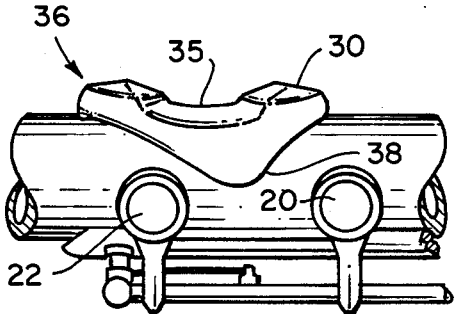
FIG. 7 is a side view of the saddle surface spacer clip from the other.
Figure 8:
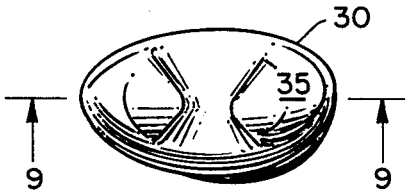
FIG. 8 is a plan view of the saddle shaped finger rest surface of the spacer clip of FIGS. 6 and 7.
Figure 9:
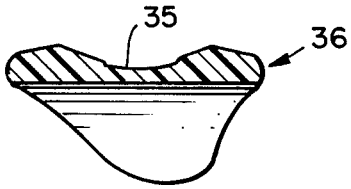
FIG. 9 is a longitudinal cross section through the saddle shaped finger rest surface spacer clip in the direction of the arrows on lines 9—9 of FIG. 8 showing the thickness profile of the spacer portion or spacer element.

An alternative left index finger rest and spacer clip 30 with a saddle shaped finger rest surface 35 is illustrated in FIGS. 6 through 8. The spacer clip 30 includes the features heretofore described with reference to FIGS. 1 through 5 however the thickness profile through the longitudinal cross section varies as illustrated in FIG. 9. At the center of the saddle shaped finger rest surface 35 the thickness of the spacer or spacer portion 36 is approximately 0.3 to 0.35 cm while at the ends the thickness profile tapers to a maximum thickness of for example at least approximately 0.6 cm. A feature and advantage of the saddle shaped finger rest surface is that it constrains and assures optimum placement and positioning of the finger or digit, particularly useful for students learning to play the flute. Other features of the saddle shaped finger rest and spacer clip 30 incorporated in the spacer clip 10 of FIGS. 1 through 5 are also included for example the skewed or off center lobe 38 as illustrated in FIG. 7.

Figure 10:
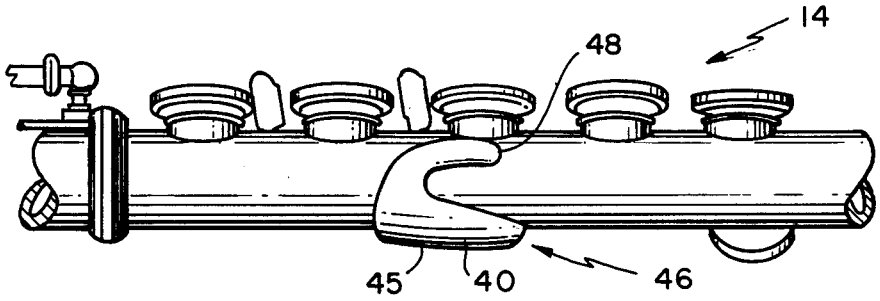
FIG. 10 is a fragmentary side view of a flute showing the right thumb position spacer clip retained in place on the undersurface between the E and F note tone holes.
Figure 11:
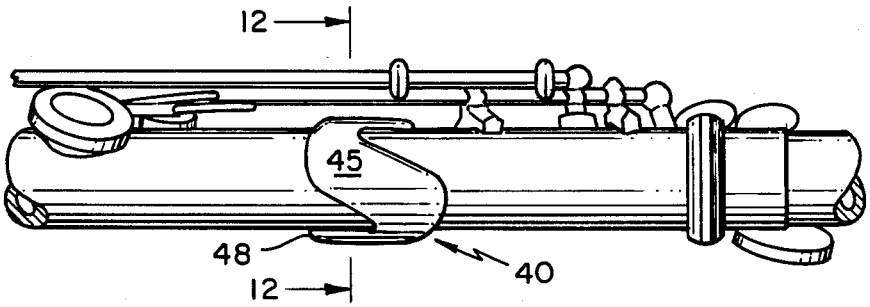
FIG. 11 is a fragmentary plan view of the right thumb position spacer clip in place on the flute.
Figure 12:
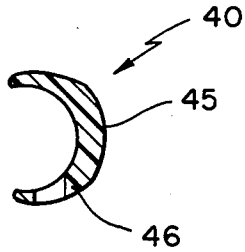
FIG. 12 is a longitudinal cross section of the right thumb position spacer clip in the direction of the arrows on lines 12—12 of FIG. 11 showing the thickness profile of the spacer portion.

A right thumb position rest and spacer clip 40 according to the invention is illustrated in FIGS. 10 through 12. The spacer clip 40 is similarly formed with a thumb or digit rest surface 45 over a spacer or spacer portion 46. The greater than half circle arc of the spacer clip 40 terminates on either side of the spacer 46 with symmetrical curved arms 48 for elastic retention of the spacer clip 40 on the undersurface of the tubular body 12 of flute 14 between the E and F tone holes. The spacer clip 40 removably grips the tubular body 12 on the opposite side of the flute from the E and F tone holes with the spacer 46 and thumb rest surface 45 at the location where the right thumb normally bears against the flute body. By this arrangement proper positioning and placement of the right thumb is assured and the thumb is displaced radially from the flute body for more favorable positioning of the right hand.

The profile thickness of the spacer clip 40 is shown in FIG. 12. The general shape of the thumb rest surface is a cylindrical curvature configuration of substantially uniform thickness of approximately at least for example 0.4 cm and in any event in the preferred range of approximately 0.3 to 0.8 cm.

Figure 13:
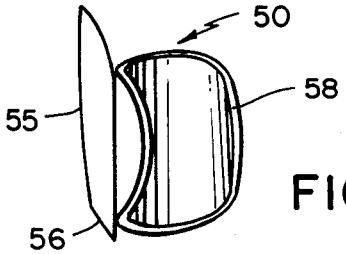
FIG. 13 is a side view of another digit spacer clip formed with a separate spacer element bonded to a circular arc clip for elastic retention on the flute body.

A further alternative embodiment of the invention is illustrated in FIG. 13. According to this embodiment the digit rest spacer clip 50 is formed by a separate spacer or spacer element 56 bonded to a greater than half circle arc clip 58. The spacer 56 may be for example of oval shape providing a finger rest or digit rest surface 55 on the upper surface which may be for example a flat surface. The thickness of the spacer 56 is in the preferred range of approximately 0.3 to 0.8 cm. In the spacer clip 50 example of FIG. 13 the greater than half circle arc clip 58 may be formed for example of a relatively soft plastic with good memory such as PVC plastic which will not mar the metal surface of the flute while the spacer 56 may be formed of a harder plastic such as for example button type plastic. Also as shown in the example of FIG. 13 the spacer 56 may be formed with an inclined edge on one side for ease in sliding the finger or digit onto the planar finger rest or digit rest surface 55.

While the invention has been described with reference to particular example embodiments it is intended to cover all modifications and equivalence within the scope of the following claims.

I claim:

1. A flute attachment for metal flutes having a round tubular flute body formed with tone holes and finger keys, comprising:

resilient elastic clamp or clip means comprising an oepn circular arc greater than a half circle, constructed and arranged for cliping onto the round tubular flute body between the upper C tone hole and the upper C finger key for resilient elastic retention to the flute body where the side of the left index finger of a flute player normally rests against the flute body for multiple functions of the left index finger as a pivot point, pressure point and operating finger for the upper C finger key, said clip means being adjustable and moveable along and around the tubular body to accommodate differing individual hand characteristics and requirements;

said resilient clip means comprising a finger rest surface for the side of the left index finger of a flute player and spacer means spacing the finger rest surface in the radial direction of the tubular flute body away from the flute body thereby effectively and substantially increasing the outer diameter of the tubular flute body at the finger rest surface;

said spacer means comprising a thickness to offset the left index finger of a flute player in the radial direction of the tubular flute body outwardly an away from the flute body a sufficient radial distance for minimizing cramping or fatigue of the left index finger and left wrist of a flute player while permitting the left index finger to perform the multiple functions as a pivot point, pressure point, and operating finger.

2. The flute attachment of claim 1 wherein the spacer means is formed with a spacing thickness in the range of approximately 0.3 to 0.8 cm in said radial direction away from the flute body.

3. The flute attachment of claim 1 wherein the spacer means is formed with sufficient thickness to offset the finger rest surface at least approximately 0.6 cm from the flute body along a radial direction away from the flute body.

4. The flute attachment of claim 1 wherein the resilient clip means comprises a relatively soft but resilient plastic to avoid marring the surface of the round tubular flute body.

5. The flute attachment of claim 1 wherein the finger rest surface comprises a saddle shaped surface.

6. The flute attachment of claim 5 wherein the minimum thickness of the spacer means at the middle of the saddle shaped surface is at least approximately 0.3 cm in said radial direction away from the flute body.

7. The flute attachment of claim 6 wherein the thickness of the spacer means at the ends of the saddle shaped surface is at least approximately 0.6 cm in said radial direction away from the flute body.

8. The flute attachment of claim 1 wherein the finger rest surface extends over a length of the metal flute body at least from the upper C tone hole to the upper C finger key and wherein the clip is shaped with a skewed side lobe for elastic retention on the flute body without interfering with adjacent tone holes or finger keys of the flute.

9. The flute attachment of claim 1 wherein the finger rest surface and spacer means are offset around the circular arc of the clip means from the center of the arc for positioning where the side of the left index finger of a flute player normally rests against the flute body when the clip means is clipped onto the flute body.

10. A flute attachment for metal flutes having a round tubular flute body formed with tone holes and finger keys, comprising:

resilient elastic clamp or clip means comprising an open circular arc greater than a half circle constructed and arranged for clipping onto the round tubular flute body where the digit of a flute player normally rests against the flute body;

said resilient clip means comprising a digit rest surface and spacer means spacing the digit rest surface in the radial direction away from the flute body thereby effectively and substantially increasing the outer diameter of the tubular flute body at the digit rest surface, said spacer means comprising a thickness to offset the digit of a flute player in the radial direction of the tubular flute body outwardly and away from the flute body a sufficient radial distance for minimizing cramping or fatigue of the digit, wrist and arm of the flute player.

11. The flute attachment of claim 10 wherein the clip means is constructed and arranged for clipping onto the round tubular flute body between the E and F tone holes with the digit rest surface and spacer means on the undersurface of the tubular flute body where the right hand thumb of a flute player normally rests against the flute body.

12. The flute attachment of claim 11 wherein the spacer means is formed with a spacing thickness of at least approximately 0.4 cm in the radial direction away from the flute body.

13. The flute attachment of claim 11 wherein the spacer means is formed with sufficient thickness to offset the digit rest surface in the range of approximately 0.3 to 0.8 cm from the flute body along a radial direction from the flute body.

14. The flute attachment of claim 11 wherein the digit rest surface and spacer means are positioned at the center of the circular arc of the clip means.

15. The flute attachment of claim 14 wherein the open circular arc is formed with symmetrical curved arms on either side of the spacer means for elastic retention on the flute body.

16. The flute attachment of claim 15 wherein the spacer means is formed with sufficient thickness to offset the finger rest surface at least approximately 0.6 cm from the flute body along a radial direction from the flute body.

17. The flute attachment of claim 15 wherein the finger rest surface comprises a saddle shaped surface.

18. The flute attachment of claim 17 wherein the minimum thickness of the spacer means at the middle of the saddle shaped surface is at least approximately 0.3 cm.

19. The flute attachment of claim 10 wherein the resilient elastic clip means is constructed and arranged for clipping onto the round tubular flute body between the upper C tone hole and the upper C finger key for resilient elastic retention to the flute body where the side of the left index finger normally rests against the flute body for multiple functions of the left index finger as a pivot point, pressure point, and operating finger the upper C finger key.

20. The flute attachment of claim 19 wherein the finger rest surface and spacer means are offset around the circular arc of the clip means from the center of the arc for positioning where the side of the left index finger of a flute player normally rests against the flute body when the clip means is clipped onto the flute body and wherein the clip is shaped with a skewed lobe on the side of the arc away from the spacer means for elastic retention on the flute body without interfering with adjacent tone holes or finger keys of the flute.

21. A flute attachment system for metal flutes having a round tubular flute body formed with tone holes and finger keys, comprising:

first resilient elastic clamp or first clip means comprising an open circular arc greater than a half circle, constructed and arranged for clipping onto the round tubular flute body between the upper C tone hole and the upper C finger key for resilient elastic retention to the flute body where the side of the left index finger of a flute player normally rests against the flute body for multiple functions of the left index finger as a pivot point, pressure point and operating finger for the upper C finger key, said first clip means being adjustable and moveable along and around the tubular body to accommodate differing individual hand characteristics and requirements;

said first clip means comprising a finger rest surface for the side of the left index finger of a flute player and first spacer means spacing the finger rest surface in the radial direction of the tubular flute body away from the flute body there by effectively and substantially increasing the outer diameter of the tubular flute body at the finger rest surface;

said first spacer means comprising a thickness to offset the left index finger of a flute player in the radial direction of the tubular flute body outwardly and away from the flute body a sufficient radial distance for minimizing cramping or fatigue of the left index finger and left wrist of a flute player while permitting the left index finger to perform the multiple functions as a pivot point, pressure point and operating finger;

seond resilient elastic clamp or second clip means comprising an open circular arc greater than a half circle constructed and arranged for clipping onto the round tubular flute body between the E and F tone holes with thumb rest surface and spacer means on the undersurface of the tubular flute body where the right hand thumb of a flute player normally rests against the flute body, said second clip means being adjustable and moveable along and around the tubular body to accommodate differing individual hand characteristics and requirements;

said second clip means comprising a thumb rest surface and second spacer means spacing the thumb rest surface in the radial direction away from the flute body thereby effectively and substantially increasing the outer diameter of the tubular flute body at the thumb rest surface, said spacer means comprising a thicknes to offset the right thumb of a flute player in the radial direction of the tubular flute body outwardly and away from the flute body a sufficient radial distance for minimizing cramping or fatigue of the right thumb, wrist and arm of the flute player.

* * * * *